US006467125B1

(12) United States Patent
Johnson

(10) Patent No.: US 6,467,125 B1
(45) Date of Patent: Oct. 22, 2002

(54) RETRACTABLE DOOR STOP FOR SLIDING DOOR

(76) Inventor: James T. Johnson, 29272 200th St., Clarksville, IA (US) 50619

( * ) Notice: Subject to any disclaimer, the term of this patent is extended or adjusted under 35 U.S.C. 154(b) by 0 days.

(21) Appl. No.: 09/645,633

(22) Filed: Aug. 24, 2000

(51) Int. Cl.[7] ..... E05F 5/02
(52) U.S. Cl. ..... 16/82; 16/85; 16/86 A
(58) Field of Search ..... 16/82, 85, 86 A, 16/86 B, 86 C; 292/251.5, DIG. 15, DIG. 19, 342, 336, 341.17, 341.18; 49/386, 181

(56) References Cited

U.S. PATENT DOCUMENTS 4,218,807 A * 8/1980 Snow ..... 16/86 A
4,343,500 A * 8/1982 Steiner ..... 292/DIG. 15
4,462,623 A * 7/1984 Grant ..... 292/DIG. 15
4,601,502 A * 7/1986 Van Dyke ..... 292/DIG. 15
5,018,241 A * 5/1991 Baines ..... 16/82
5,120,093 A * 6/1992 Carney ..... 16/82
5,593,194 A * 1/1997 Liau ..... 292/DIG. 15
5,761,766 A * 6/1998 Basham ..... 16/85 A

* cited by examiner

*Primary Examiner*—Chuck Y. Mah
(74) *Attorney, Agent, or Firm*—Allan L. Harms

(57) ABSTRACT

An improved door stop for a sliding door to reduce damage to vehicle tires passing over the door stop includes a vertically oriented housing to be embedded in the floor in alignment with the sliding door. A top block supported by a spring is slidable within the housing. A door guide is mounted to the top surface of the top block and extends above it to engage the bottom of the sliding door when the sliding door is moved to a position above the door stop. The top block remains flush with..the top of the housing and the ground surface when the spring is at rest.

18 Claims, 4 Drawing Sheets

RETRACTABLE DOOR STOP FOR SLIDING DOOR

CROSS REFERENCE TO RELATED APPLICATIONS

Not. Applicable.

STATEMENT REGARDING FEDERALLY SPONSORED RESEARCH OR DEVELOPMENT

Not Applicable

BACKGROUND OF THE INVENTION

Many businesses, including farming businesses, store vehicles, tractors, trucks and other vehicular equipment in utility buildings which are commonly referred to as "pole" buildings. This type of building usually is constructed with a metal exterior supported on peripheral internal posts and generally this type of building features a large sliding door which is suspended at its top from a track over the door opening. In order to prevent the bottom of such a sliding door from swinging, it is common practice to embed a door stop in the floor or ground surface in alignment with the sliding door to capture its bottom edge. A typical sliding door is equipped with an open channel at its bottom which receives an upstanding blade of the door stop. The blade stands above the surface of the floor or ground and may be struck by the tires of vehicles entering and leaving the building. Unfortunately, tire damage may occur when vehicle tires pass over the immoveable door stop.

BRIEF SUMMARY OF THE INVENTION

The present invention provides a door stop for a sliding door which retracts when force is applied to it in a downward direction. It is an object of this invention to provide a door stop for a sliding door which reduces the risk of damage to vehicle tires when the tires roll over the door stop.

A vertically oriented housing with an open interior, an open top and a closed bottom receives a coil spring oriented vertically therein. A top block member is receivable in the top of the housing and is vertically slidable within the housing. The top block is supported upon the upper end of the coil spring such that the upper surface of the top block rests at a position in horizontal alignment with the upper end of the housing. A door guide is fixed to the upper surface of the top block such that it extends upward. The door guide may be an elongate T-shaped rail or other upright bracket which captures the bottom of the sliding door. When the top block is at rest, the door guide extends above the upper end of the housing. The housing may be installed in an opening in the ground in the doorway of the building on which the sliding door is slidable such that the lower channel of the sliding door will receive the door guide as the door slides over the door guide. In the preferred embodiment, the housing is provided with a short rod standing upright in the center of the bottom of the housing. The short rod receives the lower end of the coil spring. The top block has a hollow interior below its upper wall in which a stub of pipe or rod may be mounted, to be in axial alignment with the short rod in the housing when the top block is received in the housing. The upper end of the coil spring may be slid over the pipe stub of the top block. The bottom of the housing may have openings therein to allow water within the housing to escape. The lower surface of the bottom of the housing has a pair of downwardly extending blades which are spaced apart to receive the end of a square post which may be mounted to the bottom end of the housing to provide a base for the housing when it is received in a post hole created to receive it.

By proper installation, the top of the housing will be flush with the floor or ground surface in which it is received. Therefore when at rest, the door guide will extend above the floor or ground surface when the top block is resting on the relaxed coil spring within the housing. When the tire of a vehicle entering or leaving the building strikes the door guide, the door guide will retract from the weight of the vehicle and will compress the coil spring, thereby creating less damaging force on the tire.

In an alternate embodiment, the housing is equipped with outwardly extending rod stock such as concrete reinforcing rods, to provide additional structure to retain the housing in a supporting mass of portland cement mix or other concrete material.

It is an object of the invention to provide a sliding door guide for a utility building into which vehicles will be moved.

It is another object of the invention to provide a door guide which is received by the lower channel of a suspended sliding door.

These and other objects of the invention will become apparent from examination of the description and claims which follow.

BRIEF DESCRIPTION OF THE SEVERAL VIEWS OF THE DRAWING(S)

DETAILED DESCRIPTION OF THE INVENTION

Figure 1:
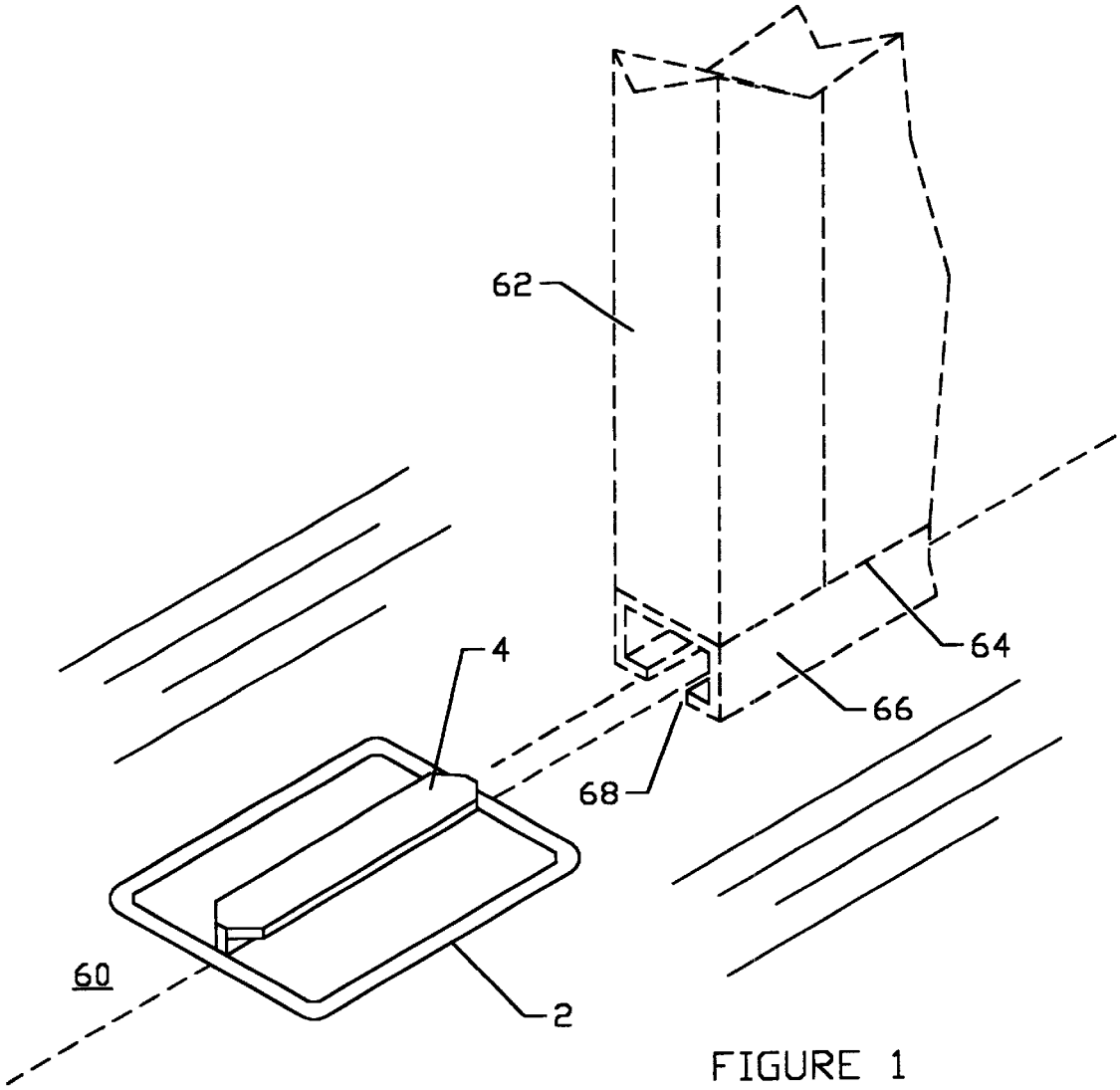
FIG. 1 is a close up view in perspective of a door stop installed in the ground surface of a door way of a general purpose building, the door guide thereof being aligned with the sliding door of the building.

FIG. 1 illustrates the invention 2 installed in a floor surface 60 in alignment with a sliding door 62 of a utility building. The sliding door 62 is provided at the bottom 64 thereof with an inverted channel 66 open at its lower end 68 such that door guide 4 of invention 2 may be slidingly received in channel 66 when door 62 is longitudinally moved over door guide 4.

Figure 2:
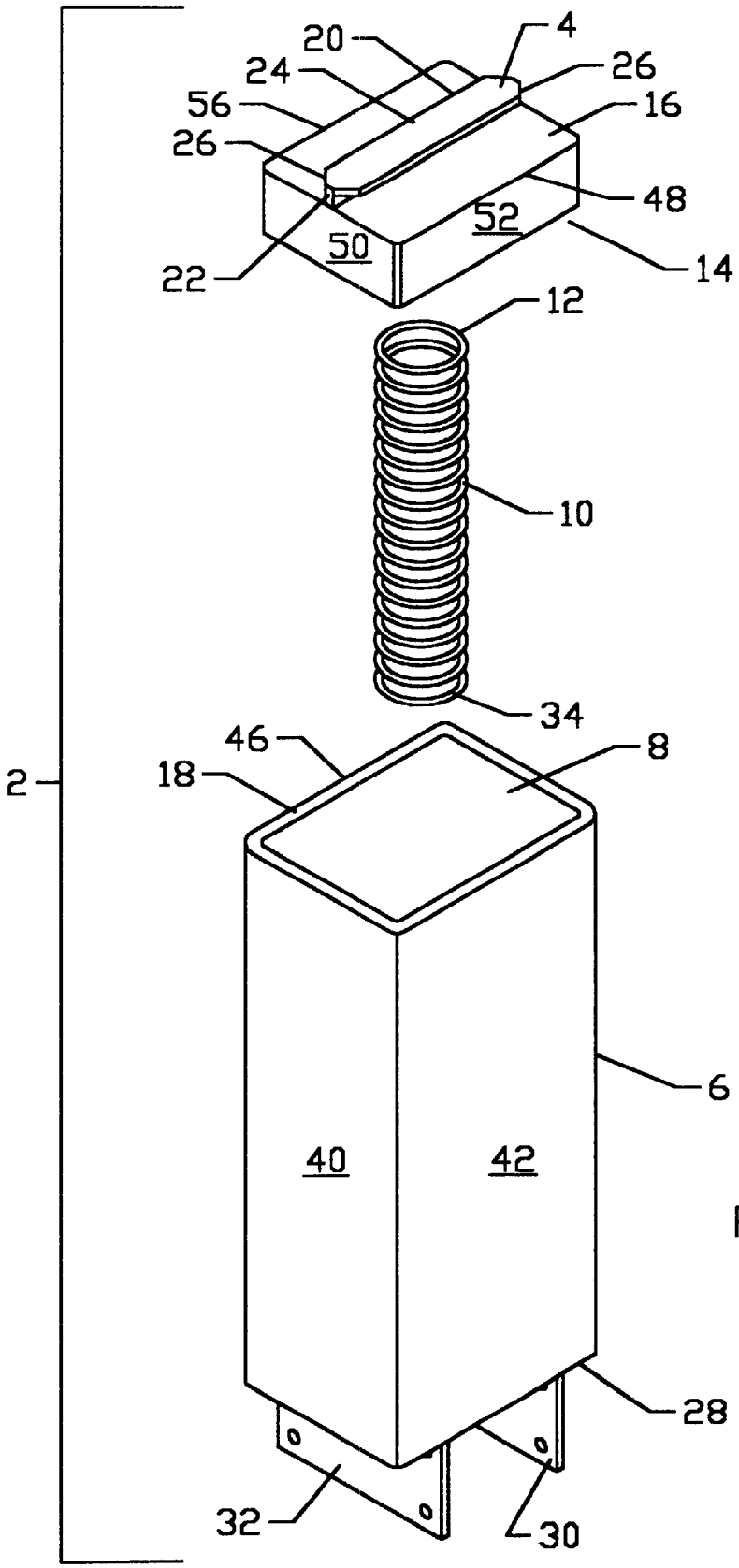
FIG. 2 is an exploded view in perspective of the preferred embodiment door stop according to the present invention.
Figure 3:
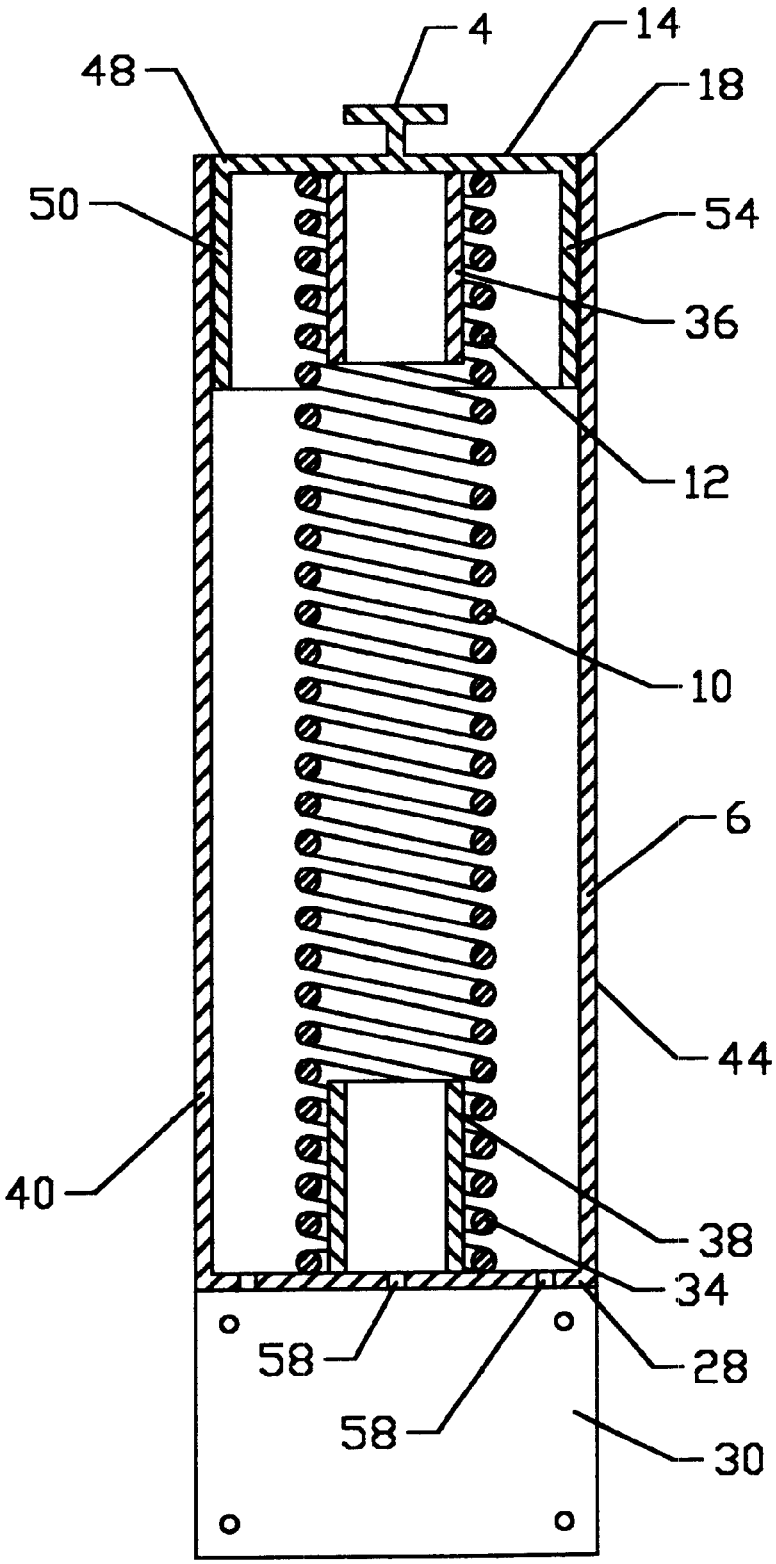
FIG. 3 is a view in section taken along a vertical midline of the preferred embodiment of FIG. 2.

Referring to FIGS. 2 and 3, the structure of the preferred embodiment of invention 2 may be observed. Invention 2 comprises an elongate hollow housing 6 oriented substantially vertically, having an open top 8. A spring 10 is disposed within housing 6 and is substantially coaxial therewith. In the preferred embodiment, spring 10 is an elongate coil spring of relatively stiff characteristics but which will compress when the weight of a wheel of a vehicle is applied to it. Spring 10 may alternatively be an elongate segment of elastomer on some other compressible spring element.

Disposed upon and supported by upper end 12 of spring 10 is top block 14 which is slidably receivable without interference in top 8 of housing 6. Top block 14 includes skirts 50, 52, 54, 56 which depend from the periphery 48 of top wall 16 of top block 14. It is intended that housing 6 and spring 10 are of such length and top block 14 of such height so as to allow top surface 16 of top block 14 to rest in horizontal alignment with upper end 18 of housing 6. It is contemplated that housing 6 will be embedded in the floor or ground at the entrance of a building equipped with a sliding door such as sliding door 62 shown in FIG. 1, such that upper end 18 of housing 6 will be flush with the surface of the ground or floor in which housing 6 is embedded.

Mounted to top surface 16 is door guide 4 which extends above it. Door guide 4 comprises an elongate rail 20 of a T-shaped cross section having a vertical wall 22 on which is centered a narrow plate 24. Plate 24 is provided with bevels 26 at the ends thereof to reduce the potential for interference of the ends of plate 24 with the inside of housing 6 when spring 10 is compressed and top block 14 slides downward in housing 6.

In some applications, rail 20 may take the shape of an inverted J to mate with a corresponding upright J bracket mounted at the bottom of the sliding door. It is to be understood that rail 20 may be made in various cross sectional shapes which will properly capture the bottom of the sliding door.

Housing 6 is provided at its bottom wall 28 with blades 30, 32 which are spaced apart and generally parallel. Blades 30, 32 depend generally perpendicularly from bottom wall 28 and are available for mounting to a support post (not shown) which may be mounted below housing 6 to support it in a post hole opened to receive housing 6, especially when housing 6 is embedded in a soil floor. Bottom wall 28 includes multiple drainage openings 34 provided to allow water collected in housing 6 to escape.

In FIG. 3 it can be seen that housing 6 is provided with upright post 38 mounted upon its bottom wall 28 which receives lower end 34 of spring 10. Similarly top block 14 is provided with a centrally disposed stub 36 mounted therein to the underside of top wall 16 such that stub 36 may receive the upper end 12 of spring 10, it being anticipated that post 38 and stub 36 will be substantially axially aligned and each may be a short length of pipe. In the preferred embodiment of FIGS. 2 and 3 it is seen that housing 6 and top block 14 are each rectangular box tubes of steel with top block 14 being slightly smaller than the open top 8 of housing 6 so that top block 14 may move freely vertically within housing 6 and yet be guided by sidewalls 40, 42, 44, 46 of housing 6.

It should be understood that though housing 6 is depicted as a rectangular box tube, it may also be formed in other cross sectioned shapes such as, for example, square, oval or triangular shapes, provided that the shape of top block 14 conforms to the interior opening of housing 6. If an open cylinder of a circular cross section were employed for housing 6, then a keying means would be required to prevent rotation of a circular top block 14 within housing 6.

In practice it is found that housing 6 is preferably about seventeen inches high, approximately 7.75 inches long and approximately six inches wide. Top block 14 is approximately seven inches long, 5.25 inches wide and 3.5 inches high. The box tubes used for housing 6 and top block 14 may be ⅜ inch thick steel.

Figure 4:
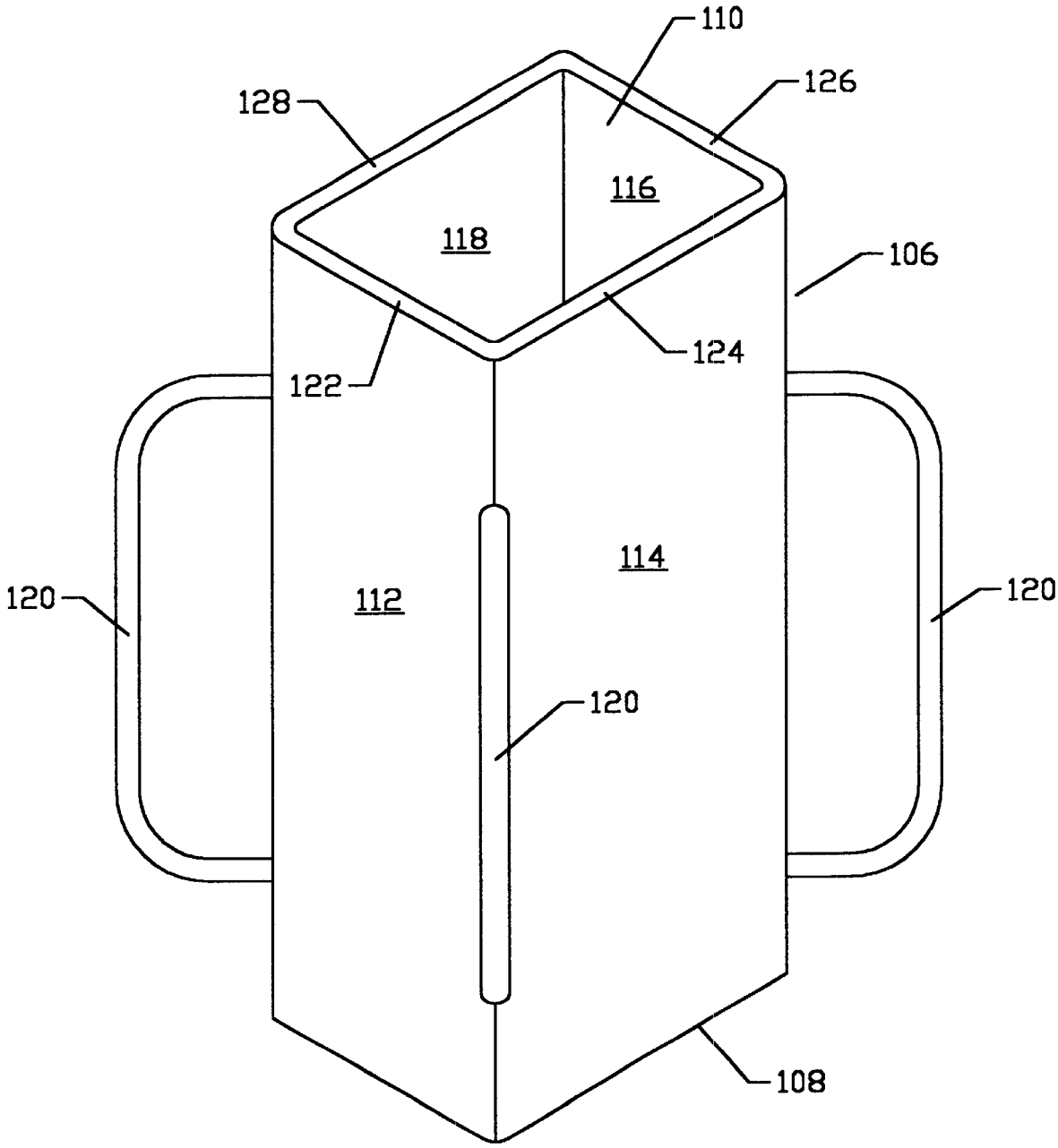
FIG. 4 is an alternate embodiment of the housing of the invention provided with reinforcing rod structures.

FIG. 4 illustrates an alternative embodiment housing 106 for use with spring 10 and top block 14 of the preferred embodiment of FIGS. 2 and 3. Alternate embodiment housing 106 comprises a vertically oriented rectangular tube with a closed bottom 108 and open top 110. Alternate embodiment housing 106 comprises four sidewalls 112, 114, 116, 118 having reinforcing rod loops 120 extending from the corners formed by adjoining sidewalls. Alternate embodiment housing 106 may be inserted in an oversize post hole with Portland cement poured around alternate embodiment housing 106 and rod loops 120 to securely mount alternate embodiment housing 106 in the post hole, it being understood that the top edges 122, 124, 126, and 128 of sidewalls 112, 114, 116, 118 respectively, will be disposed flush with the ground surface in which the alternate embodiment housing 106 is embedded so that housing 106 presents no impediment to tires or wheels passing over it. Alternate 106 may be provided with a short post (not shown) centered therewithin and mounted to its bottom wall, similar to the post 38 of preferred embodiment housing 6. Spring 10 may be installed within alternate embodiment housing 106 and top block 14 inserted in alternate housing 106 to rest upon spring 10 with its top wall 16 horizontally aligned with top edges 122, 124, 126 and 128 of alternate embodiment housing 106.

Having described the invention, I claim:

1. A door stop for a sliding door of a building comprising an elongate vertically oriented housing having a closed bottom and an open top, an elongate spring received within said housing and compressible in a vertical direction, a body slidable within said housing and supported upon said spring, said body having an upper surface thereon, said upper surface having a rail fixed thereto, said rail extending above said upper surface, whereby said upper surface of said body is substantially horizontally aligned with said top of said housing when said spring is at rest.

2. The door stop of claim 1 wherein said elongate spring has an upper end and a lower end, said body having a protrusion depending therefrom, said upper end of said spring detachably mounted to said protrusion.

3. The door stop of claim 2 where said housing has an upright post mounted therein upon the bottom thereof, said lower end of said spring detachably mounted to said upright post.

4. The door stop of claim 3 wherein said upright post is generally coaxial with said housing, said protrusion of said body disposed substantially coaxial to said upright post when said body is in said housing.

5. A door stop for engagement with a sliding door suspended by the top thereof comprising an elongate vertically oriented housing having an open top, a body slidably receivable in said housing, a spring disposed within said housing supporting said body for vertical movement thereof within said housing, said body having a top surface, said body having a door engaging element mounted to said top surface thereof and extending thereabove, the top surface substantially horizontally flush with the top of the housing when the spring is at rest, said door engaging element touchingly engaging said sliding door when said spring is at rest, said top surface deflected below the top of the housing when the spring is compressed.

6. The door stop of claim 5 wherein said housing is a box tube having sidewalls joined at perpendiculars therebetween, said body constructed of box cubing having sidewalls depending from said top surface.

7. The door stop of claim 5 wherein said housing has a bottom wall, said spring is elongate having a lower end and an upper end, said lower end of said spring supported by said bottom wall.

8. The door stop of claim 5 wherein said spring is an elongate coil spring having an upper end and a lower end, said housing having sidewalls and a bottom wall, said lower end of said spring supported by said bottom wall of said housing.

9. The door stop of claim 8 wherein said bottom of said housing has an upright post mounted thereto, said lower end of said spring receiving said upright post.

10. The door stop of claim 8 wherein said body has sidewalls depending from said top surface, a stub depending from said top surface of said body, said upper end of said spring receives said stub.

11. The door stop of claim 10 wherein, said bottom of said housing has an upright post mounted thereto, said lower end of said spring receiving said upright post.

12. The door stop of claim 11 wherein said post and said stub are substantially coaxial, each of said post and said stub is an upright cylinder.

13. The door stop of claim 5 wherein a said housing has at least one rigid member extending laterally therefrom.

14. The door stop of claim 5 wherein said housing is a hollow rectilinear box.

15. A door stop for engagement with a sliding door suspended by the top thereof comprising an elongate vertically oriented housing having an open top, a body slidably receivable in said housing, a spring disposed within said housing supporting said body for vertical movement thereof within said housing, said body having a top surface, said body having a door engaging element mounted to said top surface thereof, said door engaging element touchingly engaging said sliding door when said spring is at rest, said housing has a bottom wall, at least one blade depending from said bottom wall.

16. The door stop of claim 15 wherein said housing is a box tube having sidewalls joined at perpendiculars therebetween, said body constructed of box tubing having sidewalls depending from said top surface, said spring is an elongate coil spring having an upper end and a lower end, said housing having sidewalls and a bottom wall, said lower end of said spring supported by said bottom wall of said housing, said bottom of said housing having an upright post mounted thereto, said lower end of said spring receiving said upright post, a stub depending from said top surface of said body, said upper end of said spring receiving said stub, said post and said stub are substantially coaxial, each of said post and said stub is an upright cylinder.

17. A door stop for a sliding door of a building comprising an elongate vertically oriented housing having an open top, an elongate spring received within the housing and compressible in a vertical direction, a body slidable within the housing and supported upon the spring, the body having an upper surface thereon, the upper surface of the body substantially horizontally aligned with the top of the housing when the spring is at rest, the sliding door having a free lower end, the upper surface having a door engaging member mounted thereupon, the door engaging member extending above the upper surface, the door engaging member capturing the free lower end of the sliding door when the spring is at rest and the sliding door is slid over the door engaging member.

18. The door stop of claim 17 wherein the door engaging member comprises a protruding element, the sliding door having a top end, the lower end of the door comprising a receiving element thereon, the sliding door suspended at its top end from a track mounted to the building, the protruding element receivable in the receiving element of the sliding door when the spring is at rest, whereby the sliding door is substantially prevented from rotating about its top end when the protruding element is received in the receiving element of the sliding door.

* * * * *